US008769726B2

(12) United States Patent
Burke

(10) Patent No.: US 8,769,726 B2
(45) **Date of Patent: *Jul. 8, 2014**

(54) LOWER TORSO GARMENT SYSTEM

(71) Applicant: Rodney B. Burke, Catonsville, MD (US)

(72) Inventor: Rodney B. Burke, Catonsville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/757,473

(22) Filed: Feb. 1, 2013

(65) Prior Publication Data

US 2013/0145524 A1 Jun. 13, 2013

Related U.S. Application Data

(63) Continuation of application No. 12/790,041, filed on May 28, 2010, now Pat. No. 8,397,314.

(51) Int. Cl.

| | |
|---|---|
| ***A41B 9/04*** | (2006.01) |
| ***A41D 13/00*** | (2006.01) |
| ***A41B 9/00*** | (2006.01) |
| *A41D 1/08* | (2006.01) |

(52) U.S. Cl.

CPC ..... *A41B 9/00* (2013.01); *A41D 13/0015* (2013.01); *A41D 1/08* (2013.01)

USPC ..... 2/408; 2/400; 2/403; 2/404; 2/406; 2/238; 450/132

(58) Field of Classification Search

CPC ..... A41B 9/026; A41B 9/005

USPC ..... 2/400, 239, 240, 241, 242, 409, 227, 2/228, 237, 338, 339, 341, 84, 7, 8.1, 2/243.1; 450/132, 95, 104, 111, 131, 450/100, 106, 155, 107, 123, 99, 119, 12

See application file for complete search history.

(56) References Cited

U.S. PATENT DOCUMENTS

| | | | | |
|---|---|---|---|---|
| 2,732,556 | A * | 1/1956 | Erteszek | 450/104 |
| 3,094,990 | A | 6/1963 | Neilson | |

(Continued)

FOREIGN PATENT DOCUMENTS

| | | |
|---|---|---|
| EP | 715817 | 6/1996 |

OTHER PUBLICATIONS

URL: http://store.nike.com/index.jsp?country=US_locale=en_US#1=shop,pdp,ctr-inline/cid-1/pid-224519/pgid-224518.

(Continued)

*Primary Examiner* — Danny Worrell
*Assistant Examiner* — Khaled Annis
(74) *Attorney, Agent, or Firm* — The Law Firm of Andrea Hence Evans, LLC

(57) ABSTRACT

An article of clothing includes a front portion, a rear portion oppositely positioned from the front portion, a waistband encircling a top of each of the front portion and the rear portion, a right leg panel and a left leg panel extending downward from the waistband in the rear portion, a rear right band extending downward from the waistband and flanking a lateral edge of the right leg panel, a rear left band extending downward from the waistband and flanking a lateral edge of the left leg panel, a sacrum guide that runs horizontally between the rear right band and the rear left band, and a pubis guide.

9 Claims, 4 Drawing Sheets

(56) References Cited

U.S. PATENT DOCUMENTS

| | | | | | |
|---|---|---|---|---|---|
| 3,133,541 | A | | 5/1964 | Lewis et al. | |
| 3,279,469 | A | * | 10/1966 | Schustack | 450/113 |
| 3,524,449 | A | | 8/1970 | Peters | |
| 3,974,836 | A | * | 8/1976 | Carlson | 450/102 |
| 4,325,379 | A | | 4/1982 | Ozbey | |
| 4,355,425 | A | | 10/1982 | Jones et al. | |
| 4,400,832 | A | | 8/1983 | Kinder | |
| 4,501,024 | A | | 2/1985 | Russo | |
| 4,612,674 | A | | 9/1986 | Hashimoto | |
| 4,698,847 | A | | 10/1987 | Yoshihara | |
| 4,870,958 | A | | 10/1989 | Webster | |
| 5,131,100 | A | | 7/1992 | Atwater et al. | |
| 5,239,706 | A | | 8/1993 | Stevenson | |
| 5,435,014 | A | | 7/1995 | Moretz et al. | |
| 5,590,548 | A | | 1/1997 | Osborne | |
| 5,611,722 | A | | 3/1997 | Osborne | |
| 5,689,836 | A | | 11/1997 | Fee et al. | |
| 5,784,723 | A | | 7/1998 | Noble et al. | |
| 5,876,395 | A | | 3/1999 | Hart et al. | |
| 5,888,118 | A | * | 3/1999 | Kishi | 450/122 |
| 5,954,564 | A | | 9/1999 | Ganz | |
| 5,974,592 | A | | 11/1999 | Tabrizi | |
| 6,023,789 | A | | 2/2000 | Wilson et al. | |
| 6,058,514 | A | | 5/2000 | Hart | |
| 6,076,193 | A | | 6/2000 | Hood | |
| RE36,905 | E | * | 10/2000 | Noble et al. | 2/400 |
| 6,209,143 | B1 | | 4/2001 | Hancock | |
| 6,360,375 | B1 | | 3/2002 | Hart | |
| 6,401,250 | B1 | | 6/2002 | McNabb | |
| 6,430,753 | B2 | | 8/2002 | Duran | |
| 6,613,034 | B2 | | 9/2003 | Nozaki et al. | |
| 6,728,973 | B1 | | 5/2004 | Webley et al. | |
| 7,024,892 | B2 | * | 4/2006 | Blakely | 66/177 |
| 7,081,036 | B1 | | 7/2006 | Howard et al. | |
| 7,087,032 | B1 | * | 8/2006 | Ikeda | 602/19 |
| 7,089,601 | B2 | | 8/2006 | Chen | |
| 7,143,453 | B2 | | 12/2006 | Duran | |
| D548,927 | S | | 8/2007 | Peryman | |
| 7,257,847 | B2 | | 8/2007 | Hart | |
| 7,377,834 | B2 | * | 5/2008 | Fu | 450/99 |
| D575,928 | S | | 9/2008 | Dacumos | |
| D575,929 | S | | 9/2008 | Dacumos | |
| D581,128 | S | | 11/2008 | Blumenfeld | |
| 7,533,423 | B2 | | 5/2009 | Rudolph | |
| 7,568,966 | B2 | | 8/2009 | Abbey et al. | |
| D603,582 | S | | 11/2009 | Fennell | |

OTHER PUBLICATIONS

URL: http://store.nike.com/?country=US__locale=en__US#1=shop,pdp,ctr-inline/cid-1/pid-262195/pgid-262197.

* cited by examiner

LOWER TORSO GARMENT SYSTEM

CROSS-REFERENCE TO RELATED APPLICATION

This application is a continuation of U.S. patent application Ser. No. 12/790,041 filed on May 28, 2010, the contents of which, in its entirety, are herein incorporated by reference.

BACKGROUND

1. Technical Field

The embodiments herein generally relate to clothing garments, and, more particularly, to lower torso clothing garments.

2. Description of the Related Art

The human lower torso includes a pelvic region or pelvis. In the adult human, the pelvis is formed in the posterior dorsal (back) by the sacrum and the coccyx (the caudal part of the axial skeleton), and laterally and anteriorly by a pair of hip bones. The sacrum is a large, triangular bone at the base of the spine and at the upper and back part of the pelvic cavity, where it is inserted like a wedge between the two hip bones. The android pubic bone is the ventral and anterior of the three principal bones composing either half of the pelvis. The buttocks are rounded portions of the anatomy located on the posterior of the pelvic region. The buttocks are formed by masses of the gluteal muscles, which include the gluteus maximus muscle and the gluteus medius muscle superimposed by a layer of fat.

The gluteus maximus is the largest and most superficial of the three gluteal muscles. It makes up a large portion of the shape and appearance of the buttocks. Lower torso garments such as underwear, girdles, and athletic garments are worn by humans for fit, form, and functionality. Undergarments or underwear are clothes worn under other clothes, often next to the skin. They keep outer garments from being soiled by perspiration and other discharges, shape the body, and provide support for parts of the body. Girdles are used to project a slimmer, more aesthetic image. However, the conventional structure and design of such foundation garments typically involve the use of extremely dense elastic or other wearable material to surround and tightly retain the waist, abdomen, and/or buttocks area of a wearer.

Furthermore, the extended use of such garments can be uncomfortable to the wearer, or in worse situations, can be potentially harmful since they restrict circulation or blood flow to some of the areas of the body surrounded by such girdles. In addition, such conventional foundation garments also frequently include semi-rigid stays or similar reinforcing components, strategically located so as to further retain and/or constrict predetermined parts of the body, which may have more of a tendency to protrude or cause parts to be abnormally enlarged, such as is prevalent in people who are overweight.

Current lower torso support garments for athletic use that are flexible are also known. However, current lower torso support garments generally treat the gluteus maximus as a singular unit, which in many forms, compress the buttocks together resulting in increased friction and intense accumulation of body heat and moisture between the buttocks, leading to chafing and accelerated fungus growth. Moreover, some current lower torso garments provide a very loose and relaxed fit, but due to the singular treatment of the gluteus maximus, garment material can become entrapped between the buttocks (e.g., wedgies) resulting in discomfort and chafing between buttocks even during moderate physical activity, such as walking. Accordingly, there is a need for an enhanced lower torso garment.

SUMMARY

In view of the foregoing, an embodiment herein provides an article of clothing comprising a front portion; a rear portion oppositely positioned from the front portion; a waistband encircling a top of each of the front portion and the rear portion; a right leg panel and a left leg panel extending downward from the waistband in the rear portion; a rear right band extending downward from the waistband and flanking a lateral edge of the right leg panel; a rear left band extending downward from the waistband and flanking a lateral edge of the left leg panel; a material void region in the rear portion forming a gap between the rear right band and the rear left band; and a sacrum guide that runs horizontally between the rear right band and the rear left band.

The article of clothing may further include a rear center panel that separates the rear right band and the rear left band. The right leg panel and the left leg panel may be joined from the waistband to the sacrum guide. The rear center panel may extend downwardly from the waistband to an approximately vertical midpoint of the rear portion. The article of clothing may further include a pubis guide that forms a first connection point between the right leg panel and the left leg panel and forms a first boundary of the material void region. The sacrum guide forms a second connection point between the right leg panel and the left leg panel and forms a second boundary of the material void region. A front support panel may also be included that extends from at least one of the pubis guide and the sacrum guide to a middle of the waistband at the front portion.

The rear right band may connect with the rear left band to form a single band between the waistband and the sacrum guide. The rear right band and the rear left band may form a generally biconcave shape from the waistband downward. A flexible panel may be positioned over the material void region. The rear right band and the rear left band may extend from the waistband and pass adjacent to the sacrum guide and the pubis guide. The material void region may extend downward from an approximately vertical midpoint of the rear portion. The article of clothing further comprises a front right band and a front left band operatively connected to the waistband at the front portion, wherein the right leg panel connects to the front right band, and wherein the left leg panel connects to the front left band.

In another aspect, a lower torso garment system (LTGS) having a front portion and a rear portion is provided. The LTGS includes a right leg panel and left leg panel; a rear right band adjacent to a lateral edge of the right leg panel at the rear portion; a rear left band adjacent to a lateral edge of the left leg panel at the rear portion; a waistband that operatively connects the right leg panel and the left leg panel; a front right band and a front left band operatively connected to the waistband at the front portion; a front panel positioned between the front right band and the front left band at the front portion; a pubis guide positioned between the front right band and the front left band; a sacrum guide positioned between the rear right band and the rear left band at the rear portion; and a material void region extending from the sacrum guide to the pubis guide.

The LTGS may further include a rear center panel that extends from a top middle portion of the waistband to an approximate vertical midpoint of each of the right leg panel and the left leg panel of the rear portion. The rear right band may connect with the rear left band to form a single band. The right leg panel contours a right buttock of a wearer. The left leg panel contours a left buttock of the wearer. The LTGS may further include a flexible panel that covers the material void region.

The right leg panel cups a right gluteus maximus of a wearer, and the left leg panel separately cups a left gluteus maximus of the wearer. The material void region may extend downward from an approximate vertical midpoint of each of the right leg panel and the left leg panel of the rear portion. The material void region separates the right leg panel from the left leg panel of the rear portion. Moreover, the right leg panel is operatively connected to the rear right band and the front right band, and the left leg panel is operatively connected to the rear left band and the front left band. The front left band, the front right band, the left leg panel, and the right leg panel may comprise stretchable material. The material void region provides a gap between the right buttock of the wearer and the left buttock of the wearer and fits between a pubis to a sacrum region of the wearer.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1A:
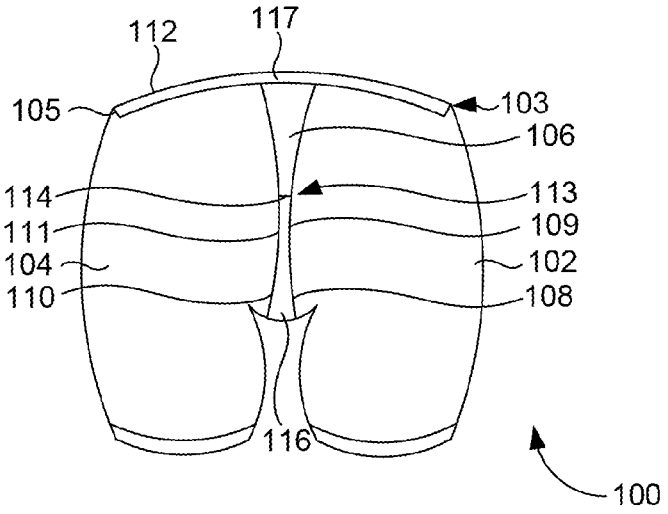
FIG. 1A illustrates a rear view of a LTGS according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein. Furthermore, the drawings, while illustrated to describe the embodiments herein, are not necessarily drawn to scale.

The embodiments herein provide a lower torso garment apparatus for facilitating natural body movement of a right buttock and a left buttock of a wearer/user and providing contoured fitting that provides exceptional wicking and cooling characteristics in the region between the right buttock and the left buttock. Referring now to the drawings and more particularly to FIGS. 1A through 2D, where similar reference characters denote corresponding features consistently throughout the figures, there are shown preferred embodiments.

Figure 1B:
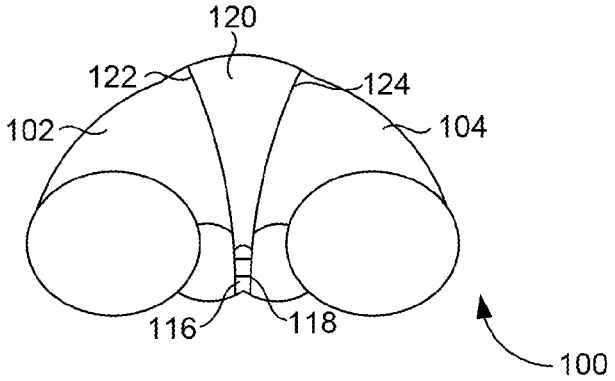
FIG. 1B illustrates a bottom view of a LTGS according to an embodiment herein.
Figure 1C:
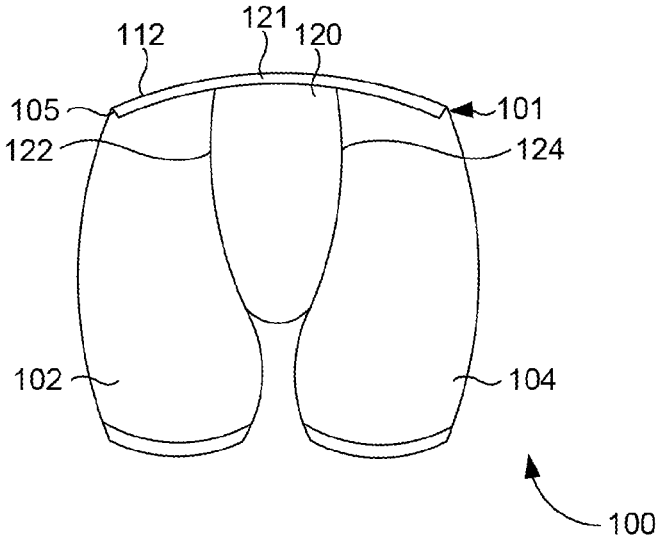
FIG. 1C illustrates a front view of a LTGS according to an embodiment herein.
Figure 1D:
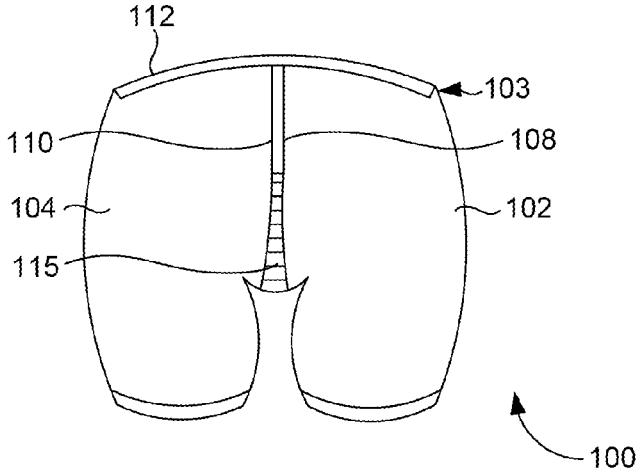
FIGS. 1D through 1F illustrate alternative rear views of a LTGS according to an embodiment herein.
Figure 1E:
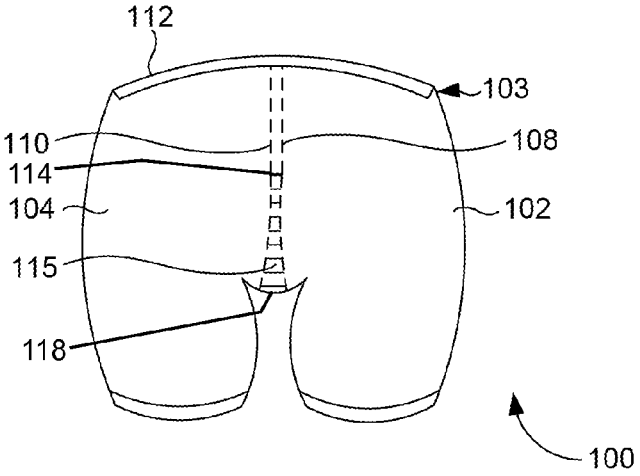
Figure 1F:
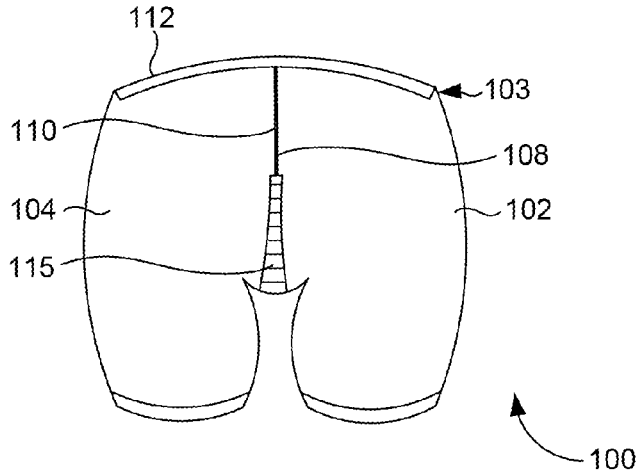
Figure 2A:
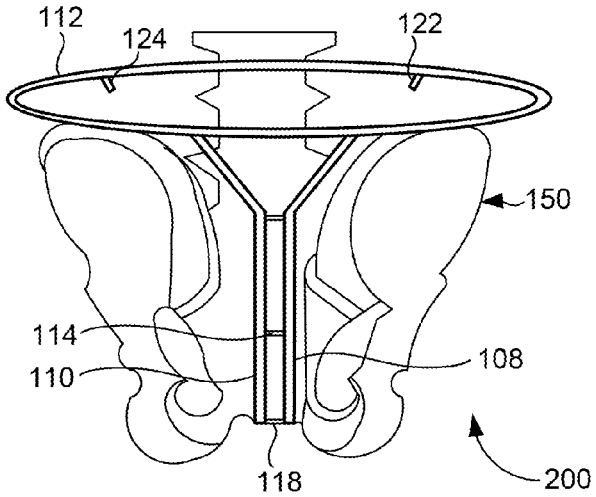
FIG. 2A illustrates a rear view of a frame-only LTGS overlaid on a pelvic region of a wearer/user according to an embodiment herein.
Figure 2B:
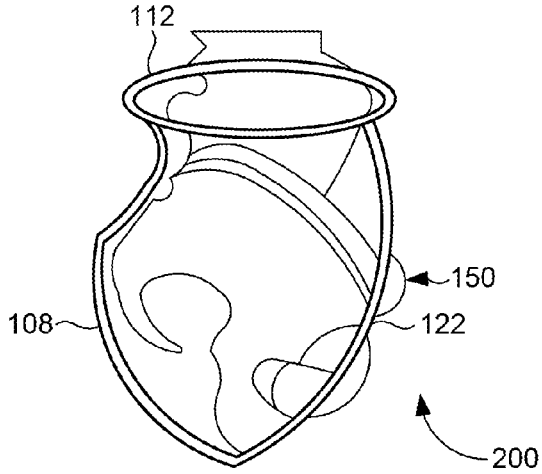
FIG. 2B illustrates a side view of a frame-only LTGS overlaid on a pelvic region of a wearer/user according to an embodiment herein.
Figure 2C:
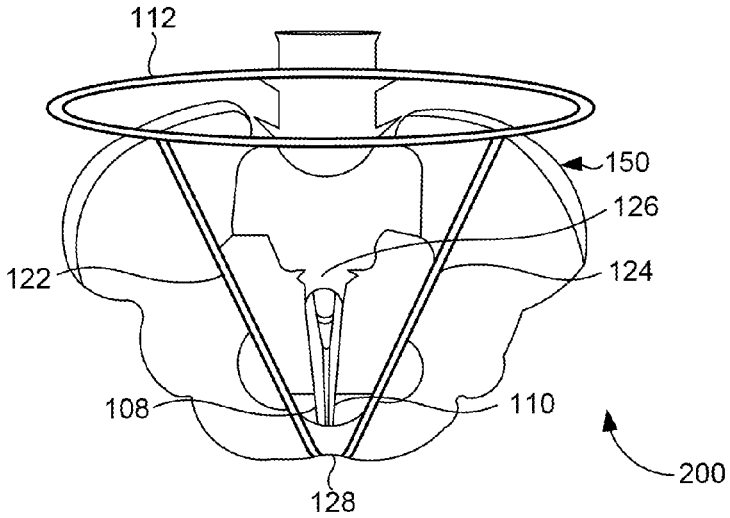
FIG. 2C illustrates a front view of a frame-only LTGS overlaid on a pelvic region of a wearer/user according to an embodiment herein.
Figure 2D:
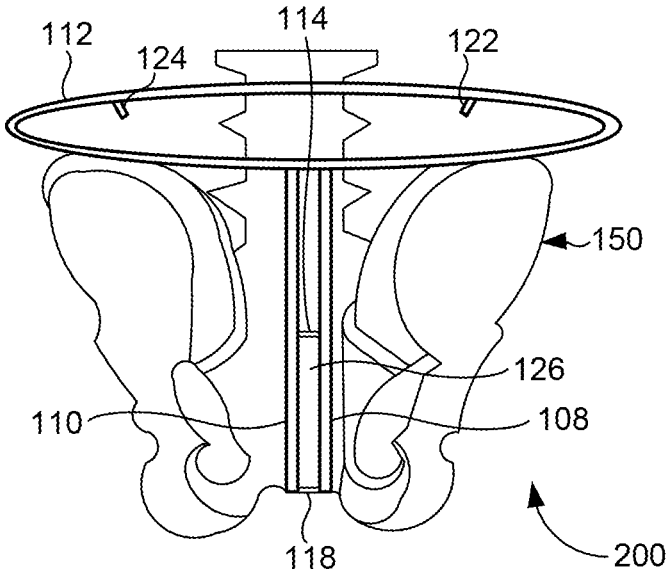
FIG. 2D illustrates a rear view of a frame-only LTGS overlaid on a pelvic region of a wearer/user according to an alternate embodiment herein.

FIGS. 1A through 1C illustrate rear, bottom, and front views, respectively, of a LTGS 100 according to an embodiment herein. FIGS. 1D through 1F illustrate alternative rear views of the LTGS 100 according to the embodiments herein. Generally, the LTGS 100 includes a right leg panel 102, a left leg panel 104, an optional rear center panel 106, a rear right band 108, a rear left band 110, a waistband 112, a sacrum guide 114, a material void region 116, a pubis guide 118, a front support panel 120, a front right band 122, and a front left band 124.

More specifically, the LTGS 100 comprises a front portion 101 (as viewed in FIG. 1C); a rear portion 103 (as viewed in FIG. 1A and FIGS. 1D through 1F) oppositely positioned from the front portion 101; a waistband 112 encircling a top 105 of each of the front portion 101 and the rear portion 103; a right leg panel 102 and a left leg panel 104 extending downward from the waistband 112 in the rear portion 103; a rear right band 108 extending downward from the waistband 112 and flanking a lateral edge 109 of the right leg panel 102; a rear left band 110 extending downward from the waistband 112 and flanking a lateral edge 111 of the left leg panel 104; a material void region 116 in the rear portion 103 forming a gap between the rear right band 108 and the rear left band 110; and a sacrum guide 114 that runs horizontally between the rear right band 108 and the rear left band 110. Moreover, the rear right band 108 faces the rear left band 110. Additionally, in one embodiment, shown in FIG. 1F, the rear right band 108 connects with the rear left band 110 to form a single band between the waistband 112 and the sacrum guide 114.

In one embodiment, the right leg panel 102 and the left leg panel 104 are joined from the waistband 112 to the sacrum guide 114 as shown in FIG. 1E where the dashed lines corresponding to the rear right band 108 and rear left band 110 indicate that the panels 102, 104 pass over the underlying bands 108, 110 and thereby the panels 102, 104 are joined together. In one embodiment, shown in FIG. 1A, the LTGS 100 comprises an optional rear center panel 106 that separates the rear right band 108 and the rear left band 110, wherein the rear center panel 106 downwardly extends from the waistband 112 to an approximately vertical midpoint 113 of the rear portion 103. In another embodiment, shown in FIG. 1D, the rear right band 108 and rear left band 110 are adjacent to one another and may or may not connect to one another, and as mentioned above, the bands 108, 110 may optionally connect to one another to form a unified center band that connects the waistband 112 to the sacrum guide 114, as shown in FIG. 1F.

The LTGS 100 further comprises a pubis guide 118 that forms a first connection point between the right leg panel 102 and the left leg panel 104 and forms a first boundary of the material void region 116, wherein the sacrum guide 114 forms a second connection point between the right leg panel 102 and the left leg panel 104 and forms a second boundary of the material void region 116. In other words, the sacrum guide 114 and pubis guide 118 define the vertical boundaries of the material void region 116. The rear right band 108, which is adjacent to the right leg panel 102, frames a right half of the lower torso by traversing the pelvis from the front to the back, and passing through the pubis and sacrum. The right leg panel 102 contours the right buttock (not shown) of a wearer/user 150 (shown in FIGS. 2A through 2D). Similarly, the rear left band 110, which is adjacent to the left leg panel 104, frames the left half of the lower torso by traversing the pelvis from the front to back, passing through the pubis and sacrum. The left leg panel 104 contours the left buttock (not shown) of the wearer/user 150.

The sacrum guide 114 and pubis guide 118 may be configured in different ways, and the embodiments herein are not limited to any particular configuration. For example, the sacrum guide 114 and pubis guide 118 may comprise any of a band, thread, panel, patch, confluence point, a series of connection points, any combination of the above singularly or in plurality, or any other mechanism that facilitates the joining, confluence, or meeting of different structures.

As shown in FIGS. 1B and 1C, the LTGS 100 further comprises a front support panel 120 that extends from either the pubis guide 118 or the sacrum guide 114 to the approximate middle 121 of the waistband 112 at the front portion 101. The front support panel 120 may be configured as a stretchable fabric support panel. The pubis guide 118, which allows for lower buttock movement, is positioned between the material void region 116 and the front support panel 120. Moreover, the rear right band 108 and the rear left band 110 form a generally biconcave shape from the waistband 112 downward. In an alternative embodiment, a flexible panel 115 (as shown in FIGS. 1D through 1F) is positioned over the material void region 116. This gives the appearance of a continuous material across the entire buttock region. The flexible panel 115 may be configured as a continuous structure with the front support panel 120. Alternatively, the flexible panel 115 may be configured as a separate structure that is operatively connected to any of the front support panel 120, the right leg panel 102, the left leg panel 104, the optional rear center panel 106, the rear right band 108, the rear left band 110, and the waistband 112.

Furthermore, in one embodiment, the rear right band 108 and the rear left band 110 extend from the waistband 112 and pass adjacent to the sacrum guide 114 and pubis guide 118. In one embodiment, the material void region 116 extends downward from an approximately vertical midpoint 113 of the rear portion 103. Additionally, the material void region 116 is substantially centrally located in the rear portion 103 according to one embodiment herein. The front right band 122 and a front left band 124 are operatively connected to the waistband 112 at the front portion 101, wherein the right leg panel 102 connects to the front right band 122, and wherein the left leg panel 104 connects to the front left band 124. In one embodiment the right leg panel 102 and left leg panel 104 wrap around the LTGS 100 extending from the front portion 101 to the rear portion 103 without having any side bands configured along the hip area to separate the front portion 101 from the rear portion 103. Alternatively, and while not shown, side bands configured along the hip area may be used to separate the leg panels 102, 104 from the respective front and rear portions 101, 103.

In one embodiment, the front right band 122 and rear right band 108 are configured as a single continuous band structure, and the front left band 124 and the rear left band 110 are configured as a single continuous band structure. The right leg panel 102 and the left leg panel 104 are configured as fabric panels that fit the underlying right and left buttock (not shown), respectively. The waistband 112 is also preferably configured as a single continuous band structure and encircles the top 105 of the LTGS 100 and fits the waist of a wearer/user 150. Again, in one embodiment, the right leg panel 102 and the left leg panel 104 are separated by an optional rear center panel 106, shown in FIG. 1A, which extends from a top approximate middle portion 117 of the waistband 112 of the rear portion 103 of the LTGS 100 to the approximate middle 113 of the rear portion 103 of the LTGS 100 according to an embodiment herein. The right and left leg panels 102, 104 can be configured of varying leg lengths and made of a stretchable fabric material.

The front right band 122 and the front left band 124 run from the pubis guide 118 to the waistband 112 at the front of the LTGS 100. The right and left front bands 122 and 124, respectively, contour the right and left legs of a wearer/user 150 and the corresponding support panels 102, 104 and provide a structural continuity of the front portion 101 of the LTGS 100 (as shown in FIG. 1C), and more particularly to the groin of a wearer/user 150. As previously mentioned, in another alternative embodiment, the rear right band 108 and the rear left band 110 are positioned underneath the panels 102, 104 as shown in FIG. 1E. In a further alternative embodiment, the rear right band 108 and the rear left band 110 are joined together such that they appear as one conjoined band as shown in FIG. 1F, and may be positioned underneath the panels 102, 104. The alternative embodiments shown in FIGS. 1D through 1F may or may not include the flexible panel 115 thereby exposing the underlying material void region 116 (not shown in FIGS. 1D through 1F), and the alternative embodiments shown in FIGS. 1D through 1F may or may not include an optional rear center panel 106.

FIGS. 2A through 2D, with reference to FIGS. 1A through 1F, illustrate rear, side, and front views, respectively, of a frame-only LTGS 200 overlaid on a pelvic region of a wearer/user 150 according to an embodiment herein. The rear right band 108 extends from the waistband 112 from the front portion 101 of the LTGS 200 and contours the posterior portion of the right side of the pelvis. The front right band 122 extends from the waistband 112 at the rear portion 103 of the LTGS 200 and contours the posterior portion of the right side of the pelvis. Similarly, the rear left band 110 extends from the waistband 112 at the front portion 101 of the LTGS 200 and contours the posterior portion of the left side of the pelvis of the wearer/user 150. The front left band 124 extends from the waistband 112 at the rear portion 103 of the LTGS 200 and contours the posterior portion of the left side of the pelvis of the wearer/user 150. The rear right band 108 and the rear left band 110 extend at the waistband 112 from the rear of the LTGS 200 contouring the dorsal surface of the sacrum 126 and ending at the pubis guide 118 which contours the pubis bone 128.

The LTGS 100, 200, which contours the lower torso, is particularly well-suited for activities involving lower torso movement such as exercise, sports, dancing, outdoor activities, walking, running, martial arts, etc. In addition, the LTGS 100, 200 is suited for use as under dress garments. The LTGS 100, 200 is further configured to work in harmony with a natural body movement of a wearer/user 150 by having a material void region 116 in between the pubis guide 118 and sacrum guide 114 (and correspondingly, in between the pubis 128 and sacrum 126) that divides the right and left gluteus maximus regions, thereby allowing independent garment movement for the right and left half of the lower torso. With respect to the material void region 116, the right and left panels 102, 104 respectively contour the full gluteus maximus, which provide a material barrier between the buttocks. Furthermore, the LTGS 100, 200 provides a near frictionless material barrier between the right and left buttock, which alleviates bun-compression, and which further prevents excessive material gathering from occurring. Hence, the LTGS 100, 200 avoids the common problems of chaffing, friction, material build-up (e.g., wedgies), excessive heat, and moisture build-up that typically occur from using conventional undergarments, including compression shorts and loose fitting undergarments particularly in an athletic/workout environment.

Generally, as described above with reference to FIGS. 1A through 2D, the embodiments herein provide a LTGS 100, 200 having a front portion 101 and a rear portion 103, wherein the LTGS 100, 200 comprises a right leg panel 102 and left leg panel 104; a rear right band 108 adjacent to a lateral edge 109 of the right leg panel 102 at the rear portion 103; a rear left band 110 adjacent to a lateral edge 111 of the left leg panel 104 at the rear portion 103; a waistband 112 that operatively connects the right leg panel 102 and the left leg panel 104; a front right band 122 and a front left band 124 operatively connected to the waistband 112 at the front portion 101; a front panel 120 positioned between the front right band 122 and the front left band 124 at the front portion 101; a pubis guide 118 positioned between the front right band 122 and the front left band 124; a sacrum guide 114 positioned between the rear right band 108 and the rear left band 110 at the rear portion 103; and a material void region 116 extending from the sacrum guide 114 to the pubis guide 118. In one embodiment, the right leg panel 102 and left leg panel 104 are connected together from the waistband 112 down to the sacrum guide 114 and the rear right band 108 and rear left band 110 are positioned underneath the right leg panel 102 and left leg panel 104. Furthermore, in one embodiment, the rear right band 108 and rear left band 110 may be positioned adjacent to one another, and in another embodiment the rear right band 108 and rear left band 110 may contact one another from the sacrum guide 114 to the waistband 112 in the rear portion 103.

The LTGS 100, 200 further comprises an optional rear center panel 106 that extends from a top middle portion 117 of the waistband 112 to an approximate vertical midpoint 113 of each of the right leg panel 102 and the left leg panel 104 of the rear portion 103. In one embodiment, the right leg panel 102 and the left leg panel 104 are joined from the waistband 112 to the sacrum guide 114. In one embodiment, the rear right band 108 connects with the rear left band 110 to form a single band. The right leg panel 102 contours a right buttock of a wearer/user 150, and the left leg panel 104 contours a left buttock of the wearer/user 150. The right leg panel 102 cups a right gluteus maximus of a wearer/user 150, and the left leg panel 104 separately cups a left gluteus maximus of the wearer/user 150. The LTGS 100, 200 further comprises an optional flexible panel 115 that covers the material void region 116.

The material void region 116 extends downward from an approximate vertical midpoint 113 of each of the right leg panel 102 and the left leg panel 104 of the rear portion 103, and the material void region 116 separates the right leg panel 102 from the left leg panel 104 of the rear portion 103. Moreover, the material void region 116 provides a gap between the right buttock of the wearer/user 150 and the left buttock of the wearer/user 150 and fits between a pubis 128 to a sacrum 126 region of the wearer/user 150. Moreover, the right leg panel 102 is operatively connected to the rear right band 108 and the front right band 122, and the left leg panel 104 is operatively connected to the rear left band 110 and the front left band 124. Furthermore, the front left band 124, the front right band 122, the left leg panel 104, and the right leg panel 102 preferably comprise stretchable material.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. An article of clothing comprising:

a front portion;

a rear portion oppositely positioned from said front portion;

a waistband encircling a top of each of said front and said rear portion;

a right leg panel and a left leg panel extending downward from said waistband in said rear portion;

a front separate right band extending downward from said waistband and connected to a lateral edge of said right leg panel;

a separate front left band extending downward from said waistband and connected to a lateral edge of said left leg panel;

a separate right and left rear band extending downward from said waistband from the front portion to the rear portion and connected to a lateral edge of each of said right leg panel and said left leg panel, respectively and extending to a pubis guide, wherein said rear bands comprise a substantially biconcave shape from said waistband downward and contours a right and left buttock, respectively;

the pubis guide positioned adjacent to a pubis area of said user, and positioned between said front right band and said front left band;

a sacrum guide positioned adjacent to a sacrum of said user, and positioned above said pubis guide between said front right band and said front left band;

a material void region extending from the sacrum guide to the pubis guide;

wherein the material void region forms a gap between the right and left rear band allowing independent movement of the right and left buttock; and a flexible panel positioned over the material void region operatively connected to said right leg panel, said left panel, and said waistband.

2. An article of clothing adapted to be worn around a pelvis of a user comprising:

a front portion;

a rear portion oppositely positioned from said front portion;

a waistband encircling a top of each of said front portion and said rear portion;

a right leg panel and a left leg panel extending downward from said waistband in said rear portion;

a separate front right band extending downward from said waistband and connected to a lateral edge of said right leg panel;

a separate front left band extending downward from said waistband and connected to a lateral edge of said left leg panel;

a separate rear right band that contours a posterior portion of a right side of the pelvis;

a separate rear left band that contours a posterior portion of a left side of the pelvis; and a stretchable flexible front panel positioned in a front area between the front left band and the front right band;

a rear flexible panel connected to the stretchable flexible front panel positioned in a rear area between said right rear band and said rear left band, wherein said rear flexible panel is a separate structure from said right leg panel, said left leg panel, said rear band, and said waistband, wherein said rear right band and said rear left band permit independent movement of said right leg panel and said left leg panel, and wherein said rear right band and said rear left band form a substantially biconcave shape extending downward from said waistband.

3. The article of clothing of claim 2, wherein said right leg panel and said left leg panel comprise a first type of stretchable material having first type of stretchable material properties, and wherein said rear right band and said rear left band comprise a second type of stretchable material having second type of stretchable properties.

4. The article of clothing of claim 2, wherein said rear right band and said rear left band are adjacent to each other.

5. The article of clothing adapted to be worn around a pelvis of a user of claim 2, further comprising a sacrum guide that runs horizontally between the right rear band and the left rear band.

6. The article of clothing adapted to be worn around a pelvis of a user of claim 5, wherein the rear right band connects with the rear left hand to form a single rear band between the waistband and the sacrum guide.

7. The article of clothing of claim 1, wherein the flexible panel is continuous with a front support panel positioned on the front portion.

8. The article of clothing of claim 1, wherein the front right band and front left band are stretchable.

9. The article of clothing of claim 2, wherein the front right hand and front left band are stretchable.

* * * * *